United States Patent [19]

Meyer et al.

[11] 3,979,909

[45] Sept. 14, 1976

[54] HYDRAULIC ACTUATOR

[75] Inventors: Kenneth Herbert Meyer; William Elisa Heese, both of Akron, Ohio

[73] Assignee: HydraPower Inc., Wadsworth, Ohio

[22] Filed: Jan. 12, 1976

[21] Appl. No.: 648,496

[52] U.S. Cl. ..... 60/458; 60/DIG. 10; 60/484; 91/411 R

[51] Int. Cl.[2] ..... F15B 21/00

[58] Field of Search ..... 60/458, 484, 485, DIG. 10; 92/59, 128; 214/12; 91/411 R

[56] References Cited

UNITED STATES PATENTS

| | | | |
|---|---|---|---|
| 3,279,172 | 10/1966 | Kudo et al. | 60/484 |
| 3,299,635 | 1/1967 | Forster et al. | 60/484 |
| 3,651,635 | 3/1972 | Clay | 60/484 X |

*Primary Examiner*—Edgar W. Geoghegan
*Attorney, Agent, or Firm*—Donnelly, Maky, Renner & Otto

[57] ABSTRACT

A rotary hydraulic actuator adapted to be mounted as on the stationary kingpin fixed on the deck of a self-unloading bulk cargo ship for slewing of a conveyor boom having its foot pivotally connected to oppositely extending horizontal trunnions on the actuator, said actuator being characterized by its unitized construction in which the gear housing is journalled on a gear keyed on said kingpin and which has pairs of parallel cylinders extending in opposite directions from the gear housing for actuating gear racks which mesh with said gear. Said actuator is further characterized in that extending longitudinally in opposite directions from the gear housing between the respective pairs of cylinders is a hydraulic oil tank and a weatherproof power pack assembly (or hydraulic actuating system) operatively connected with the tank and including a hydraulic pump and drive motor therefor and valves to control flow of fluid under pressure to selected cylinders for rotation of said actuator in desired boom-slewing direction.

For a large size actuator of the character indicated, the complete assembly is of such great length and width as not to be transportable by truck or rail from the manufacturer's plant to the shipyard or other location and hence, in the unitized construction herein only the trunnion mountings are detached for shipping purposes without disturbing the hydraulic system components and piping whereby the remaining unitized structure, while of relatively great length, is then sufficiently narrow so as to be conveniently shippable to the shipyard or other location by rail or truck whereat the trunnion mountings may be bolted in place and seal-welded to opposite sides of the gear housing without disturbing the hydraulic system.

10 Claims, 4 Drawing Figures

HYDRAULIC ACTUATOR

BACKGROUND OF THE INVENTION

Heretofore, in large size rotary hydraulic actuators of the character indicated the main unit has included the trunnions as an integral part thereof and hence it was necessary for shipment to detach the power pack and the pairs of hydraulic cylinders and piping on opposite sides of said unit and to send the manufacturer's personnel to the shipyard or other location to reassemble the hydraulic cylinders and piping and power pack onto said unit thereby entailing substantial additional expense and highly skilled labor.

SUMMARY OF THE INVENTION

In contradistinction to the foregoing the present utitized rotary hydraulic actuator is completely assembled insofar as the operating parts of the actuator are concerned including the oil reservoir, the gear housing, the hydraulic cylinders which actuate gear racks meshing with the gear adapted to be fixed to the stationary kingpin on the deck of the ship, and the hydraulic valves, pump, and drive motor and is sufficiently narrow and low in height for shipment by rail or truck. The trunnion mountings together with locating bolts are shipped disassembled from opposite sides of the gear housing whereby said trunnion mountings may be bolted in place at the shipyard or other location and seal-welded to close the gear housing, such assembly work being done by shipyard personnel without disturbing any of the cylinders, hydraulic connections, valves, pump, drive motor, etc.

Other objects and advantages of the present invention include improved hydraulic circuitry to prevent overloading of the hydraulic system as when the boom-slewing control valve is shifted to a neutral position to arrest slewing movement of the boom; the provision of a removable cover and enclosure for the hydraulic system whereby removal of the cover provides access to the various control valves, filters, etc. for servicing, and removal of the enclosure provides access to the pump and drive motor for servicing; and the provision of readily accessible supply and return piping between the oil tank and the hydraulic system and cross-over piping interconnecting two pairs of oppositely extending hydraulic cylinders for parallel operation wherein oppositely moving parallel gear racks are meshed with the gear adapted to be keyed on the stationary kingpin, said cross-over piping being connected with a fixed part of the power pack assembly by way of high pressure flexible hoses to accommodate thermal expansion and contraction of said piping and to absorb hydraulic pressure shock.

Other objects and advantages of the present invention will become apparent as the following description proceeds.

DETAILED DESCRIPTION OF A PREFERRED EMBODIMENT

Figure 1:
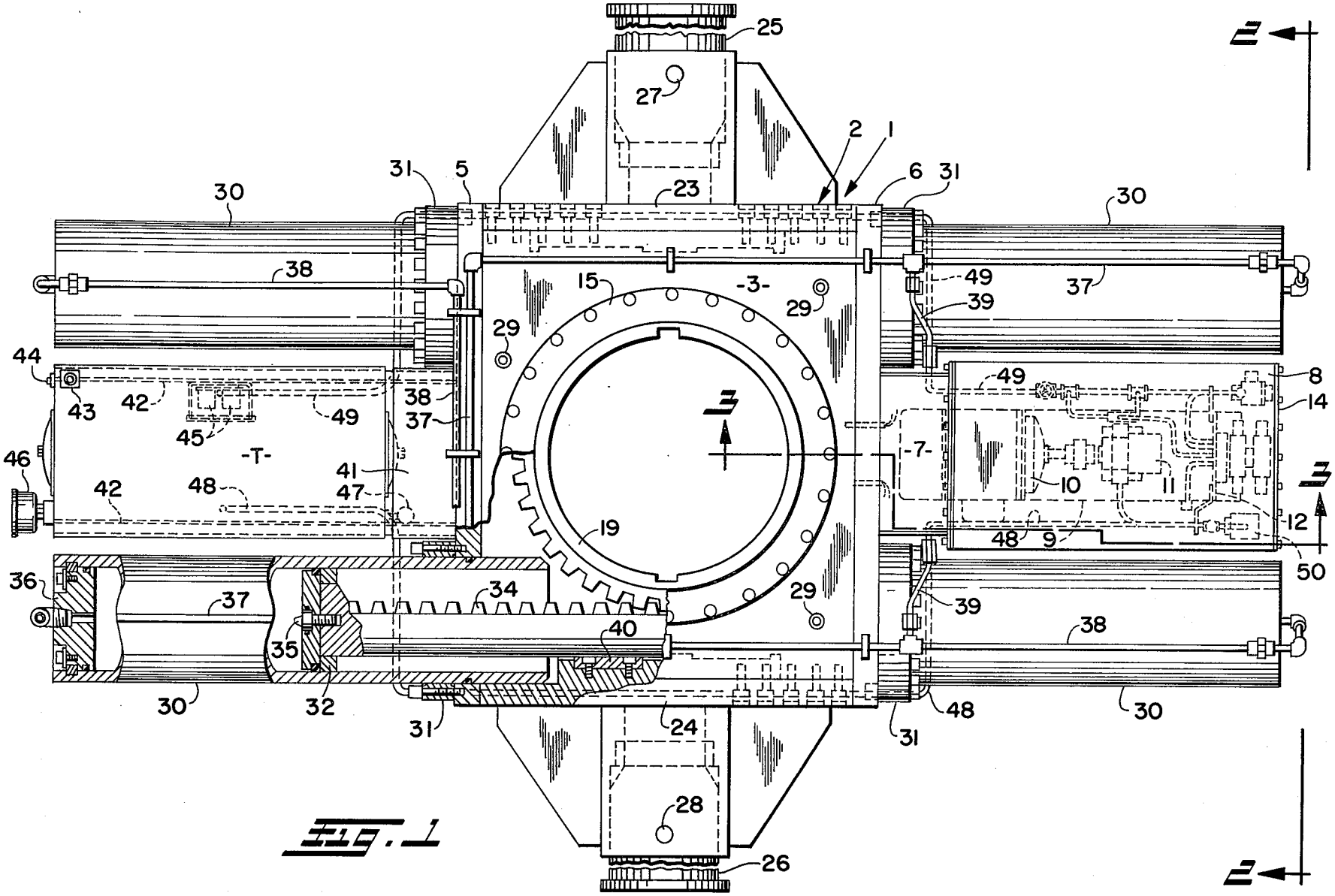
FIG. 1 is a top plan view, partly in cross-section, illustrating a preferred embodiment of the present invention.
Figure 2:
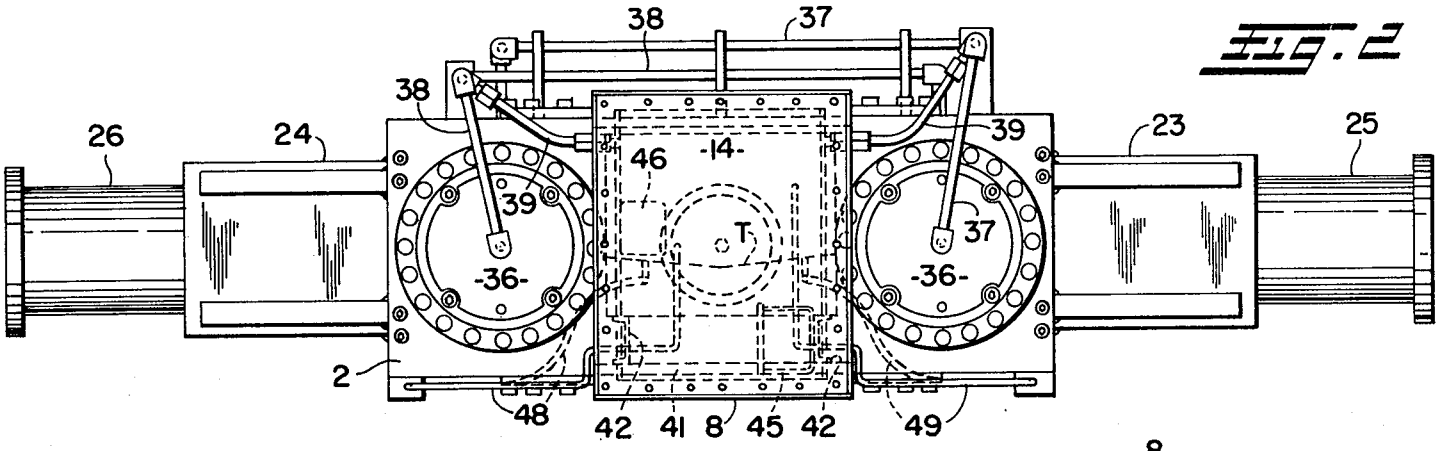
FIG. 2 is an end elevation view as viewed along the line 2—2, FIG. 1.
Figure 3:
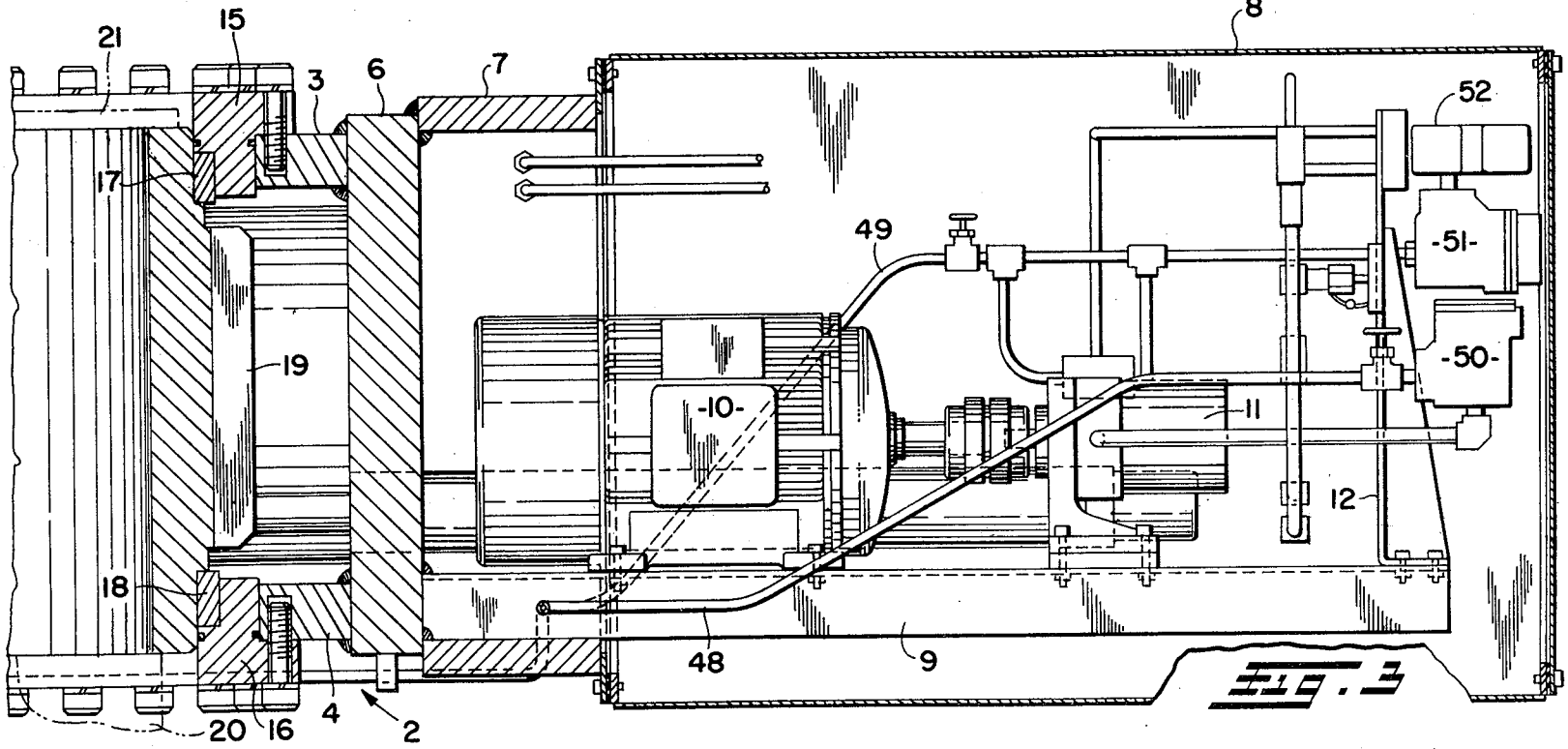
FIG. 3 is a cross-section view on somewhat enlarged scale taken substantially along the line 3—3, FIG. 1.

Referring now more particularly to the drawings and especially to FIGS. 1–3, the rotary hydraulic actuator 1 herein comprises a gear housing 2 to one end of which a hydraulic oil tank or reservoir T is attached, said gear housing 2 comprising top and bottom rectangular plates 3 and 4 to which end plates 5 and 6 are welded as best shown in FIG. 3. Also, as best shown in FIG. 3, the fixed portion 7 of the hydraulic system enclosure 8 is welded to the end plate 6 as is one end of the channel 9 which supports the drive motor 10 for the pump 11 and which has a valve support bracket 12 at its other end for various hydraulic system components as hereinafter described in detail.

The weatherproof enclosure 8 around the motor 10, pump 11, and the valves, filters and piping therewithin has a removable gasketed cover 14 to provide access for servicing of the valves and filters supported by bracket 12, and if any servicing is required in connection with the pump 11 or drive motor 10, the entire gasketed enclosure 8 may be removed from the stationary portion 7 thereof.

The top and bottom plates 3 and 4 of the gear housing 2 have coaxial central openings therethrough for receiving the bolted on retainer rings 15 and 16 for the radial and thrust bearings 17 and 18, suitable O-rings being provided as shown to seal said retainers 15 and 16 in the housing 2 and on the opposite end portions of the gear 19 which is adapted to be keyed on the upper end portion of a stationary kingpin 20. A suitable retainer plate 21 is secured as by screws to the upper end of the kingpin 20.

Opposite side plates 23 and 24 are bolted to the sides of the top and bottom plates 3 and 4, and the portions of the end plates 5 and 6 which project beyond the sides of the top and bottom plates 3 and 4 have two pairs of screws as shown therethrough screwed into holes in the opposite ends of the side plates 23 and 24. The side plates 23 and 24 have gussetted trunnion receiving bosses in which the boom trunnions 25 and 26 are secured as by the pins 27 and 28.

The top plate 3 has fill connection 29 through which the gear housing 2 may be supplied with supplementary lubricant and the bottom plate 4 will be provided with a drain valve (not shown) for draining leakage oil from the gear housing 2.

Each end plate 5 and 6 has a pair of parallel bores to receive a pair of hydraulic cylinders 30 which are sealed in said bores as by the O-rings as shown, said cylinders 30 being removably secured to the respective end plates 5 and 6 by bolts through a collar 31 affixed to each cylinder.

Each cylinder 30 has a piston 32 reciprocable therein and the respective pairs of pistons 32 in the oppositely extending coaxially aligned cylinders 30 are secured to respective gear racks 34 which mesh with the gear 19. Each piston 32 may be provided with a cushioning spear 35 which enters a bore in the cylinder end cap 36 to cushion the outer end portion of the stroke of each piston 32. The head ends of the cylinders 30 are cross-connected by pipes 37 and 38 as shown to rotate the actuator 1 in opposite directions about the gear 19 according to which two of the cross-connected cylinders 30 is receiving fluid under pressure. The pressure supply and return lines to the piping 37 and 38 are preferably in the form of flexible high pressure hoses 39 connected to fittings on the stationary part 7 of the hydraulic system enclosure 8 to accommodate thermal expansion and contraction of the piping and to absorb hydraulic shock loading.

The trunnion mounting side plates 23 and 24 are provided with arcuate bearings 40 which support the respective gear racks 34 for sliding movement and prevent bending thereof due to tooth loads of the interengaged teeth of the racks 34 and gear 19. In large size actuators 1 of the character indicated wherein for example the output torque may be about 31 million inch lbs., the overall length of the actuator 1 including the pipe fittings at the ends of the cylinders 30 may be about 17 feet 6 inches and the width of the actuator 1 across the trunnion bosses (without the trunnions 25 and 26) may be about 13 feet 4 inches. Accordingly, there is no convenient way of shipping a completed actuator 1 by truck or rail and hence the trunnion support side plates 23 and 24 are removed for shipment by removing the aforementioned locating bolts. The actuator 1 without the trunnion support side plates 23 and 24 now has a width of only about 6 feet 6 inches and thus the actuator 1 with all of its hydraulic actuating mechanism in tact may readily be shipped by truck or rail since it will then be of only 6 feet 6 inch width and 17 feet 6 inch length. At the shipyard or other site, the trunnion support plates 23 and 24 are bolted into place and seal-welded to the side plates 5 and 6 and to top and bottom plates 3 and 4 to form a gear housing 2 which contains gear lubricant.

Figure 4:
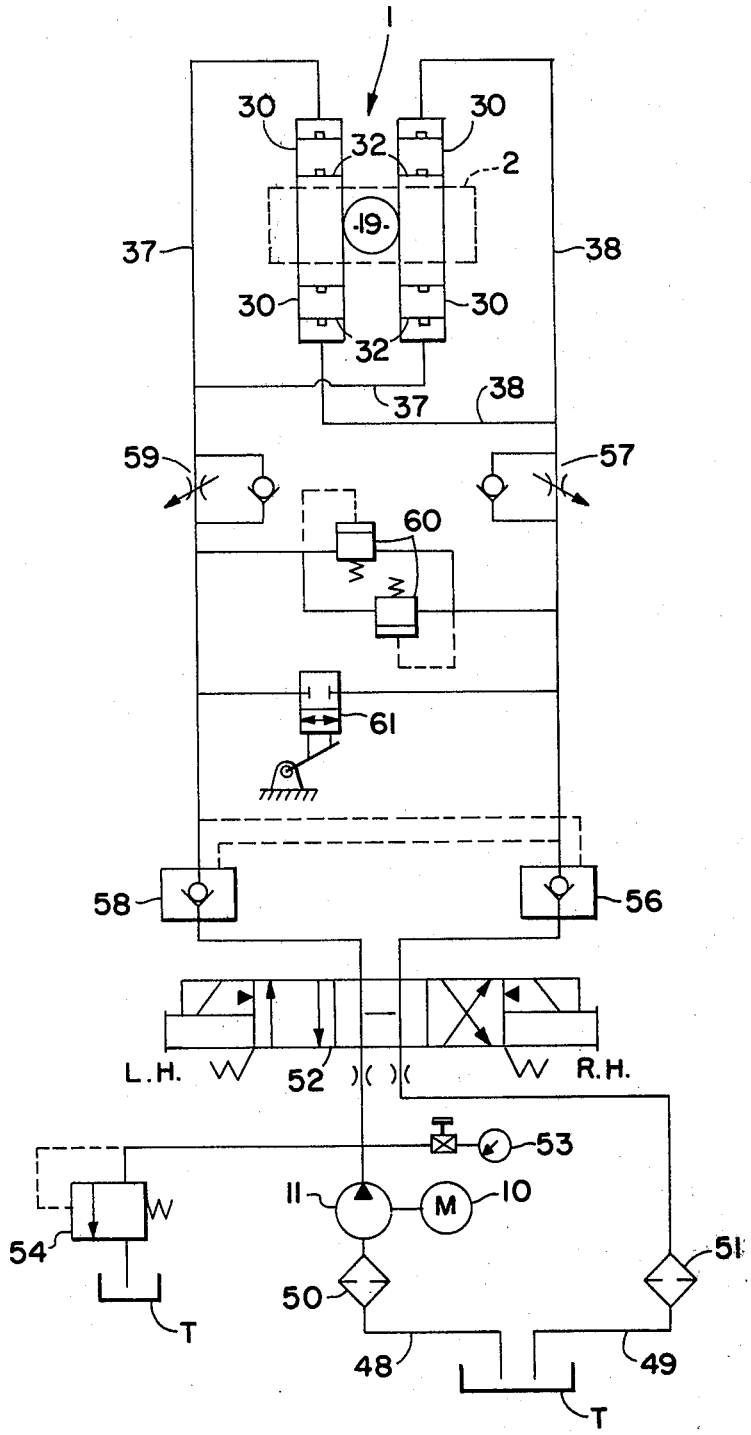
FIG. 4 is a schematic diagram of the hydraulic system.

As shown in FIGS. 1 and 2, the tank T is attached to a support structure including end plate 41 and channels 42 welded together and to the end plate 5 of the gear housing 2. Tank T has a filler-breather connection 43, a visual oil level indicator and thermometer 44, a thermostat and thermoswitch 45 with a watertight enclosure, an electric immersion heater 46 with a watertight enclosure, and an oil level indicator and shutoff switch 47. Referring additionally to FIGS. 3 and 4, the reference numeral 48 denotes the suction line from tank T to pump 11, and the reference numeral 49 denotes the return line through which oil is returned into the tank T. The portions of the lines 48 and 49 within fixed portion 7 and enclosure 8 may be low pressure flexible hoses as are the portions extending from the tank T to the pipes underneath opposite sides of the gear housing 2. Suitable filters 50 and 51 are provided in the suction and return lines 48 and 49. To control the direction of rotation of the actuator 1 about the gear 19 which is fixed to the stationary kingpin 20 is a solenoid operated four-way valve 52. Upstream of the four-way valve is a pressure gage 53 and a system relief valve 54. When the four-way valve 52 is in the position shown in FIG. 4, the pump 11 output (when motor 10 is running) will be circulated through the tank T and when the four-way valve 52 is shifted toward the left as viewed in FIG. 4, fluid under pressure will be conducted through the righthand pilot operated check valve 56 to the head ends of the upper right and lower left cylinders 30 via the cross-over piping 38 and the check valve portion of the adjustable flow control valve 57, and the pilot pressure will open the other pilot operated valve 58 for return flow from the head ends of the upper left and lower right cylinders 30 via the cross-over piping 37, the restrictor portion of the adjustable flow control valve 59, and the four-way valve 52 into the tank T via return line 49 to cause rotation of the actuator 1 in a counterclockwise direction as viewed in FIG. 4.

On the other hand when the four-way valve 52 is actuated to the right from the FIG. 4 position, fluid under pressure will be conducted through the left pilot operated check valve 58 to conduct fluid under pressure to the head ends of the upper left and lower right cylinders 30 via the check valve portion of the flow control valve 59 and the crossover piping 37, and the return flow from the head ends of the upper right and lower left cylinders 30 will be conducted through the cross-over piping 38, the variable restrictor portion of the flow control valve 57, through the pilot operated check valve 56 which is opened by pressure in the pressure supply line to conduct return flow, and through the four-way valve 52 into the tank 45 via return line 49 to cause rotation of the actuator 1 in a clockwise direction as viewed in FIG. 4.

Connected across the piping 37 and 38 are overload relief valves 60 which are operative to limit the pressure buildup when the four-way valve 52 is operated from an operating position to neutral position whereby inertia loads of the slewing boom are cushioned and excessive pressure buildup is prevented in the fluid trapped by the check valve 56 or 58 then in the return circuit.

Also connected across the piping 37 and 38 is a crossover valve 61 which is normally closed but which may be opened at will to intercommunicate the head ends of all of the cylinders 30 thus to provide a float position.

In summary, the actuator 1 herein is of unitized construction in which the central hollow gear housing 2 forms the mounting base for the hydraulic actuating system and has pairs of cross-connected cylinders 30 extending longitudinally from opposite ends of said gear housing 2 with a power pack secured to one end of the gear housing 2 and extending longitudinally between one pair of cylinders 30 and a tank T extending longitudinally between the other pair of cylinders 30. Said power pack is enclosed in a water-tight enclosure 8 and comprises a pump 11, a pump drive motor 10, and all of the hydraulic system components except the external cross-over piping 37 and 38 and the flexible high pressure hoses 39 by which the head ends of the cylinders 30 are operatively connected with the hydraulic system to cause rotation of the actuator 1 in desired direction and consequent slewing of the boom mounted on the trunnions 25 and 26. The central hollow gear housing 2 is partially filled with a lubricating grease for the interengaged teeth of the gear 19 and the gear racks 34.

A further characterizing feature of the present actuator 1 is that the trunnion mounting side plates 23 and 24 which form opposite sides of the gear housing 2 are accurately located, but are detachable for shipping purposes, whereby the customer may re-attach said side plates 23 and 24 and seal-weld the same to form a chamber for gear lubricant without disturbing either the hydraulic system or the electrical system.

The embodiments of the invention in which an exclusive property or privilege is claimed are defined as follows:

1. A rotary hydraulic actuator comprising a gear housing having top and bottom plates, opposite end plates each carrying a pair of parallel laterally spaced apart hydraulic cylinders which open into the interior of said housing, and opposite side plates having oppositely extending and aligned trunnion mounting means, said plates defining a gear lubricant chamber; a gear in said housing journalled in said top and bottom plates; first and second conduit means cross-connecting diagonally opposite cylinders with each other; pistons reciprocable in respective opposite cylinders having a gear rack therebetween meshing with said gear to relatively rotate said housing and gear according to which of said first and second conduit means is a pressure supply line while the other of said first and second conduit means is a fluid return line; a tank extending longitudinally between the pair of cylinders carried by one of said plates; a hydraulic power system extending longitudinally between the pair of cylinders carried by the other one of said end plates; said power system comprising a pump and drive means therefor and directional control valve means and including conduit means for supply of fluid from said tank to said pump and for return of fluid from said directional control valve means to said tank, and other conduit means for communicating said directional control valve with the respective first and second conduit means, and for conducting fluid pressure delivered by said pump to said directional control valve means; said directional control valve means being operative to selectively supply fluid under pressure to either of said first or second conduit means while return fluid from the other of said first and second conduit means is returned to said tank via said directional control valve.

2. The actuator of claim 1 wherein said other conduit means connected between said directional control valve means and said first and second conduit means have portions adjacent said other end plate which are flexible hoses to accommodate thermal expansion and contraction of said first and second conduit means and which absorb hydraulic shock loads.

3. The actuator of claim 1 wherein said hydraulic power system has a removable weatherproof enclosure therearound.

4. The actuator of claim 3 wherein said directional control valve is mounted adjacent the end of said enclosure which is remote from said other end plate; and wherein said enclosure has a removable cover at such remote end for servicing of said directional control valve without removal of said enclosure from said one end plate.

5. The actuator of claim 3 wherein said other end plate has a fixed extension to which said enclosure is removably secured and through which a portion of said other conduit means connected to said first and second conduit means extends.

6. The actuator of claim 1 wherein said first and second conduit means have portions parallel to the respective cylinders and lateral portions above said one end plate which cross-connect said cylinders as aforesaid.

7. The actuator of claim 1 wherein said side plates are initially removably bolted to the opposite edges of said top and bottom plates and to the opposite ends of said end plates which extend beyond the edges of said top and bottom plates, said side plates being removable to reduce the width of said actuator for shipping purposes without disturbing the hydraulic system, the tank, and said conduit means; said side plates being adapted to be re-bolted in place and seal-welded to define an enclosed gear lubricant chamber within said gear housing in conjunction with the top and bottom plates and opposite end plates.

8. The actuator of claim 1 wherein said top and bottom plates have bearing retainer rings which are sealed in openings in respective top and bottom plates and are sealed around opposite end portions of said gear; said gear being adapted to be keyed on a stationary kingpin whereby a boom secured to trunnions in said side plates is adapted to be slewed in opposite directions by operation of said directional control valve means.

9. The actuator of claim 1 wherein said hydraulic power system includes a support member fixed at one end to said other end plate, and has said drive means secured thereon adjacent to said one end and said directional control valve means secured thereon adjacent to the other end of said support member, said pump being secured to said support member between the ends thereof.

10. The actuator of claim 9 wherein said tank has a support member therebeneath which is fixed at one end to said one end plate.

* * * * *